United States Patent [19]

Mozuras et al.

[11] Patent Number: 4,986,034

[45] **Date of Patent: * Jan. 22, 1991**

[54] ADJUSTABLE DOOR FRAME ASSEMBLY

[75] Inventors: Gary Mozuras, Mt. Clemens; Dennis Perliski, Sterling Heights; Robert C. Carnick, Warren, all of Mich.

[73] Assignee: Copco Door Company, Warren, Mich.

[ * ] Notice: The portion of the term of this patent subsequent to Apr. 3, 2007 has been disclaimed.

[21] Appl. No.: 484,917

[22] Filed: Feb. 26, 1990

Related U.S. Application Data

[63] Continuation of Ser. No. 104,780, Oct. 5, 1987, Pat. No. 4,912,879.

[51] Int. Cl.[5] ..... E06B 1/60

[52] U.S. Cl. ..... 49/505; 52/217

[58] Field of Search ..... 49/505; 52/212, 217

[56] References Cited

U.S. PATENT DOCUMENTS

| | | | |
|---|---|---|---|
| 2,853,161 | 7/1955 | Miacari . | |
| 2,996,767 | 8/1961 | Kobil et al. . | |
| 3,224,152 | 12/1965 | Evans . | |
| 3,248,833 | 5/1966 | Sklar . | |
| 3,420,003 | 5/1967 | Cline . | |
| 3,585,770 | 6/1971 | Maizler . | |
| 3,654,734 | 4/1972 | Lehman . | |
| 3,788,019 | 1/1974 | Kieselewski . | |
| 3,793,788 | 2/1974 | Collins . | |
| 3,884,003 | 5/1975 | Herr et al. . | |
| 3,906,671 | 9/1975 | Maldonado . | |
| 4,012,868 | 3/1977 | Andruskiewicz . | |
| 4,179,849 | 12/1979 | Kuffner . | |
| 4,395,855 | 8/1983 | Juker . | |
| 4,527,369 | 7/1985 | Adams . | |
| 4,589,229 | 6/1986 | Warren . | |
| 4,608,781 | 9/1986 | Anders . | |
| 4,793,109 | 12/1988 | Noach | 49/505 X |
| 4,912,879 | 4/1990 | Mozuras et al. | 49/505 |

FOREIGN PATENT DOCUMENTS

| | | |
|---|---|---|
| 2422180 | 11/1975 | Fed. Rep. of Germany . |

*Primary Examiner*—James R. Brittain

*Attorney, Agent, or Firm*—Krass & Young

[57] ABSTRACT

An adjustable door frame assembly includes a frame member adapted to fit in a portion of the interior periphery of a door opening and including a raised hat portion having at least one spring clip retained therein. The assembly further includes a trim portion adapted to be slidably retained by the clip so as to allow for expansion of the frame assembly to accommodate a variety of wall thicknesses and irregularities.

The frame assembly may be utilized in conjunction with pre-hung doors and is equally well adapted for use with windows, screens and other such items.

18 Claims, 3 Drawing Sheets

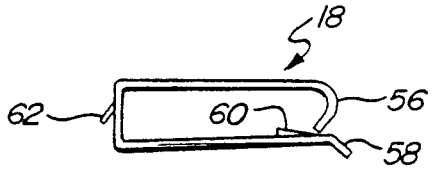
FIG. 2C
FIG. 2A
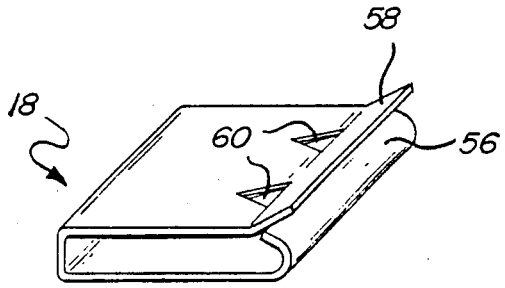
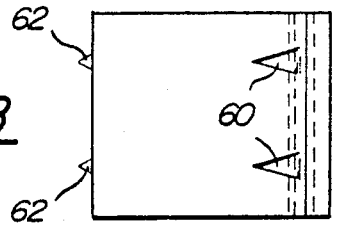
FIG. 2B
FIG. 3A
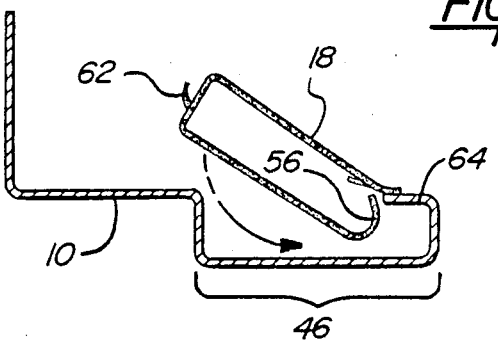
FIG. 3B
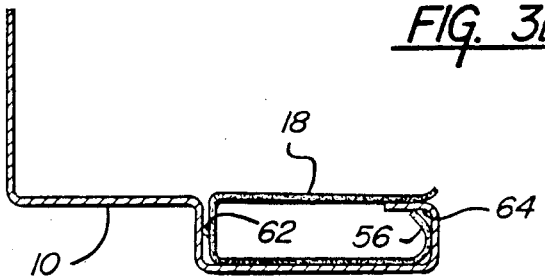

FIG. 6
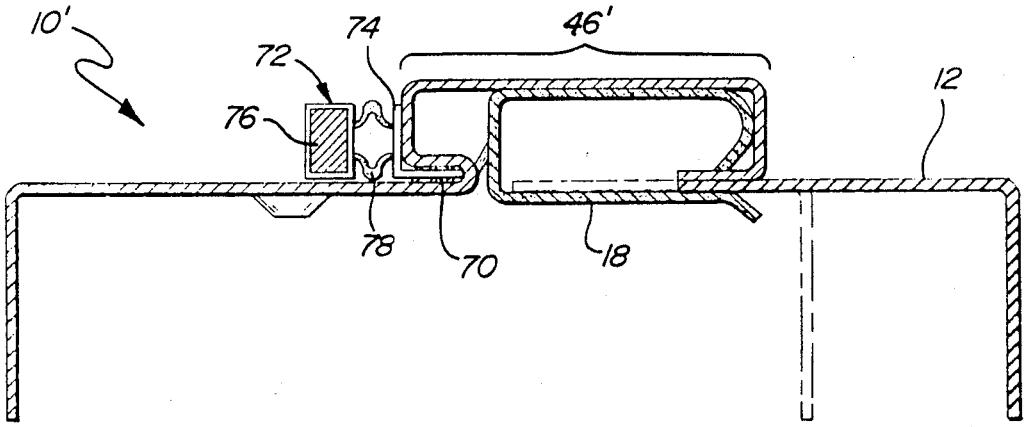
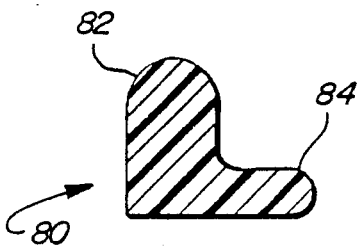
FIG. 7
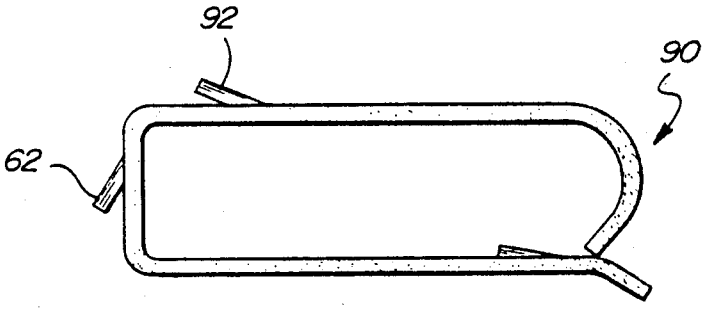
FIG. 8

ADJUSTABLE DOOR FRAME ASSEMBLY

RELATED APPLICATION

This is a continuation of U.S. application Ser. No. 104,780; filed Oct. 5, 1987 now issued as U.S. Pat. No. 4,912,879.

FIELD OF THE INVENTION

This invention relates generally to door frames and in particular to adjustable door frames adapted to accommodate door openings formed by wall thicknesses of various sizes and degrees of irregularity.

BACKGROUND OF THE INVENTION

In the usual construction of buildings, doors are hung in openings formed by boxing-in the thickness of the surrounding walls. While previously, carpenters would typically "build-in" a door by shimming and/or planing the opening to the appropriate size, shape and degree of squareness necessary to accommodate a door and then building a finished frame in the opening, it has been found more advantageous to employ prefabricated door frames. Such frames generally present a better appearance than individually built frames and also are more cost-effective insofar as the use of skilled labor, and long periods of time are not required to hang a door. Furthermore, prefabricated door frames may be manufactured from durable materials such as metals or polymeric composites and thereby provide strength not attainable with individually built door frames. For this reason, the construction trades have turned very strongly to the use of prefabricated door frames.

Such frames may be utilized in a pre-hung or non-pre-hung mode. In a pre-hung mode, the door frame is completely assembled and includes the door mounted therein. In such instances the builder will simply insert the appropriate frame in a door opening, affix the frame and attach any necessary hardware. In a non- pre-hung mode, the door frame is supplied either fully assembled or in components which are assembled into the opening and a door is subsequently affixed thereto.

Regardless of whether a pre-hung or non-pre- hung mode of construction is employed, it is generally desirable that prefabricated door frames be adjustable so as to accommodate variations in wall thickness resultant from irregularities in construction materials or techniques, as well as to accommodate openings in walls of various nominal dimensions. Frequently in the construction of buildings lumber, drywall or similar materials will be found to be slightly oversized or undersized; similarly, a door opening may be slightly out of plumb, or it may be of non-uniform width (i.e., slightly tapered). Consequently, the thickness or width of the opening may be greater at one end thereof than at the other. If door frames of fixed size were employed in such situations, they could not accommodate the irregularity. Furthermore, it is desirable to have adjustable door frames adapted to accommodate a wide variety of nominal wall thicknesses so as to obviate the necessity of warehousing numerous sizes.

It is further desirable that any such adjustable door frame be strong so as to provide sufficient security for use in mounting entry doors. Additionally, such frames should present an aesthetically attractive appearance, be of low cost and be easy to fabricate and install.

Previously, numerous designs of door frame assemblies have been fabricated which allow for some small degree of adjustability, typically up to one-half inch, so as to accommodate slight variations in wall thicknesses. Such door frame assemblies are generally manufactured as two-piece assemblies having a crimped portion adapted to retain a sliding second portion therein. While such amount of adjustability is useful, it frequently is not sufficient insofar as variations in wall size of greater than one-half inch can readily occur over a 7 or 8 foot length of a door opening. Furthermore, as previously noted, such frame designs cannot accommodate a variety of wall sizes.

In response to the need for a door frame having a greater range of adjustability, various designs have been developed. One group of adjustable door frames employs a two-piece frame assembly and has various slider or ratchet assemblies which hold the two portions in alignment while allowing for expansion or contraction thereof. For example, U.S. Pat. Nos. 2,853,161 and 4,395,855 depict slide assemblies whereas U.S. Pat. No. 3,906,671 illustrates a ratcheted assembly. While such designs do allow for adjustability, they typically are expensive to fabricate insofar as precision alignment of the sliders or other attachment mechanism is required over an extensive length of door frame during its manufacture. Additionally, use of such door frames is complicated by the necessity of previously aligning the mating portions of the frame members. The general fragility of such precise members necessitates careful handling during manufacturing, shipping and use and frequently results in ruined product.

Accordingly, it is desirable that any such adjustable door frame not require precision manufacturing steps or necessitate precise alignment during use and be rugged enough to withstand normal handling at a construction site. Disclosed in U.S. Pat. No. 3,884,003 is a two-piece door frame assembly in which a plurality of clips welded to one member of the frame retain the second portion thereof. This design eliminates some of the problems of the aforementioned frames. However, welding of the clips occasions other problems insofar as welding is an relatively expensive process to fixture, and the welded points tend to become potential rust centers. Additionally, the use of a welding process precludes manufacture of the frame from prepainted metal stock, use of which significantly reduces production cost, and eliminates time and expense associated with field painting. Another problem with the welding of attachment clips is that the welding process of necessity heats the material, thereby reducing temper and gripping efficacy of the clips. For these reasons, it is desirable to eliminate the use of a welding process in the fabrication of such frames.

U.S. Pat. No. 3,788,019 discloses an adjustable door frame system which relies upon a plurality of clips nailed to the opening in the wall to retain the door frame assembly and allow for adjustability thereof. While such clips do overcome problems occasioned by welding, their use is difficult insofar as the clips must be properly shimmed and attached to the door opening in precise alignment so as to properly retain the frame. Additionally, the frame, once assembled, cannot be removed and cannot be repositioned without removal and repositioning of the shimmed clips.

Accordingly, it will be appreciated that, despite the various designs for adjustable door frame assemblies, there is still is a need for an assembly which is simple and rapid to use, does not require precise positioning of components thereof, is capable cf withstanding rough shipping conditions, is economical to manufacture and does not necessitate welding steps.

The present invention provides for an adjustable door frame capable of accommodating a wide range of door opening thicknesses and capable of accommodating significant variations within the nominal thickness. The door frame assembly of the present invention is fabricated as a two-part assembly held together by a plurality of spring clips of unique design. The clips are retained internally of the frame assembly, may be repositioned if required, and their use eliminates the need for precise alignment of the two portions of the frame assembly. Elimination of welding steps allows for the use of economical and attractive prepainted stock material and eliminates weld damage which may result in rust. The frame assemblies of the present invention may be utilized in either a pre-hung or non-pre-hung mode and may be quickly installed and removed, without the need for shimming. These and other advantages of the present invention will be readily apparent from the drawings, descriptions and claims which follow.

BRIEF DESCRIPTION OF THE INVENTION

There is disclosed herein a frame assembly adapted to be fitted into an opening in a wall. The assembly includes a frame member having a generally planar interior surface adapted to be supported by and cover a portion of the interior periphery of the opening and an exterior surface disposed distal said interior periphery. The frame member further includes a hat portion defining a raised channel extending along the longitudinal axis of the member. The channel is substantially closed proximate the exterior surface and substantially open proximate the interior surface. The frame member further includes at least one clip member adapted to be retainably received in the raised channel and a generally planar trim piece of substantially the same length as the frame member. The trim piece has a first portion adapted to be slidably retained by the clip and a second portion adapted to cover at least a portion of the interior periphery of the opening not covered by the frame member. By sliding the trim piece in the clip, the frame assembly may be expanded to accommodate differing peripheries associated with various thicknesses of walls.

In a further embodiment, the frame member may be adapted to cover at least a portion of the exterior periphery of the opening. The frame member may further include a plurality of holes therein adapted to receive attachment members so that the frame may be affixed to the interior periphery of the opening. The attachment members may be screw threaded members and at least some of the holes may be coined holes so that the frame may be fastened to the interior periphery of the opening in a spaced apart relationship without the necessity for the use of shims.

The frame member may be fabricated from a wide variety of materials including steel, galvanized steel, aluminum, anodized aluminum, synthetic polymeric materials, wood or compressed particle board. Prepainted steel may be employed with particular advantage.

The frame assembly may include two jamb sections adapted to be disposed perpendicularly in the opening in a header section adapted to be disposed horizontally in the opening at substantially right angles to the jamb sections. The frame member may be configured to include tabs and slots disposed so as to fasten at least one of the jamb sections to the header. In a particular embodiment each of the jamb sections may be configured to include a pair of tabs and the header may include at least two sets of slots adapted to engage the tabs so that the jamb sections and header may be assembled into a rigid unit so as to prevent twisting thereof.

In yet another embodiment, the hat section may be configured to include at least one flange extending along at least a portion of the opening in the channel and adapted to retain the clip. This flange also gives extra rigidity to the frame and allows for the use of thinner gauge stock.

The clip member may include a gripping portion adapted to engage the interior portion of the channel and retain the clip therein. The clip may be a metallic member and the gripping portion may include at least one retainer prong formed in the clip. The clip may be formed of spring steel and may be further configured to include a hook portion and a tongue portion maintained and biased together contact and adapted to grip and retain a trim piece inserted therebetween. In yet a further refinement, the tongue portion of the clip may have associated therewith at least one tension tooth and/or at least one bonding prong.

The trim piece may be an elongated member having a generally L-shaped cross section one leg of which is adapted to be disposed upon and cover a portion of the interior periphery of the opening and the other leg adapted to engage and cover a portion of the exterior periphery of the opening. The trim piece may be fabricated from similar materials as the remainder of the frame.

This invention may be readily adapted to provide a pre-hung door assembly comprising a frame member adapted to retainably receive a door therein. The frame includes a header member and two jamb members disposed at right angles to opposite ends of one face of the header. The frame further includes a raised hat portion extending longitudinally across the jamb members and header member and defining a soffit portion proximate the door and an open channel distal the door. The pre-hung door assembly further includes a door hingedly retained in the frame member and a plurality of clips adapted to be retainably received in the raised channel. The assembly further includes three generally planar trim pieces, a first and second corresponding in length to the jamb members and a third corresponding in length to the header member. Each trim piece is adapted to be slidably retained by the clips whereby the pre- hung door assembly may be adjusted in size so as to accommodate various thicknesses of door openings.

BRIEF DESCRIPTION OF THE DRAWINGS

FIG. 2A is a perspective view of one embodiment of a spring clip structured in accord with the principles of the present invention;

FIG. 2B is a top plan view of the clip of FIG. 2A;

FIG. 2C is a front elevational view of the spring clip of FIG. 2A;

FIG. 3A illustrates the insertion of a spring clip of the present invention into the channel formed by the hat portion of the frame member;

FIG. 3B is an illustration in cross section of the frame member of the present invention having a spring clip retained therein;

FIG. 6 is a cross sectional illustration of another embodiment of the present invention, including a kerf adapted to receive a weatherstrip;

FIG. 7 is a cross sectional view of a compressive weatherstrip of the type which may be employed in conjunction with of FIG. 6; and, FIG. 8 is a front elevational view of another design spring clip.

DETAILED DESCRIPTION OF THE INVENTION

Figure 1:
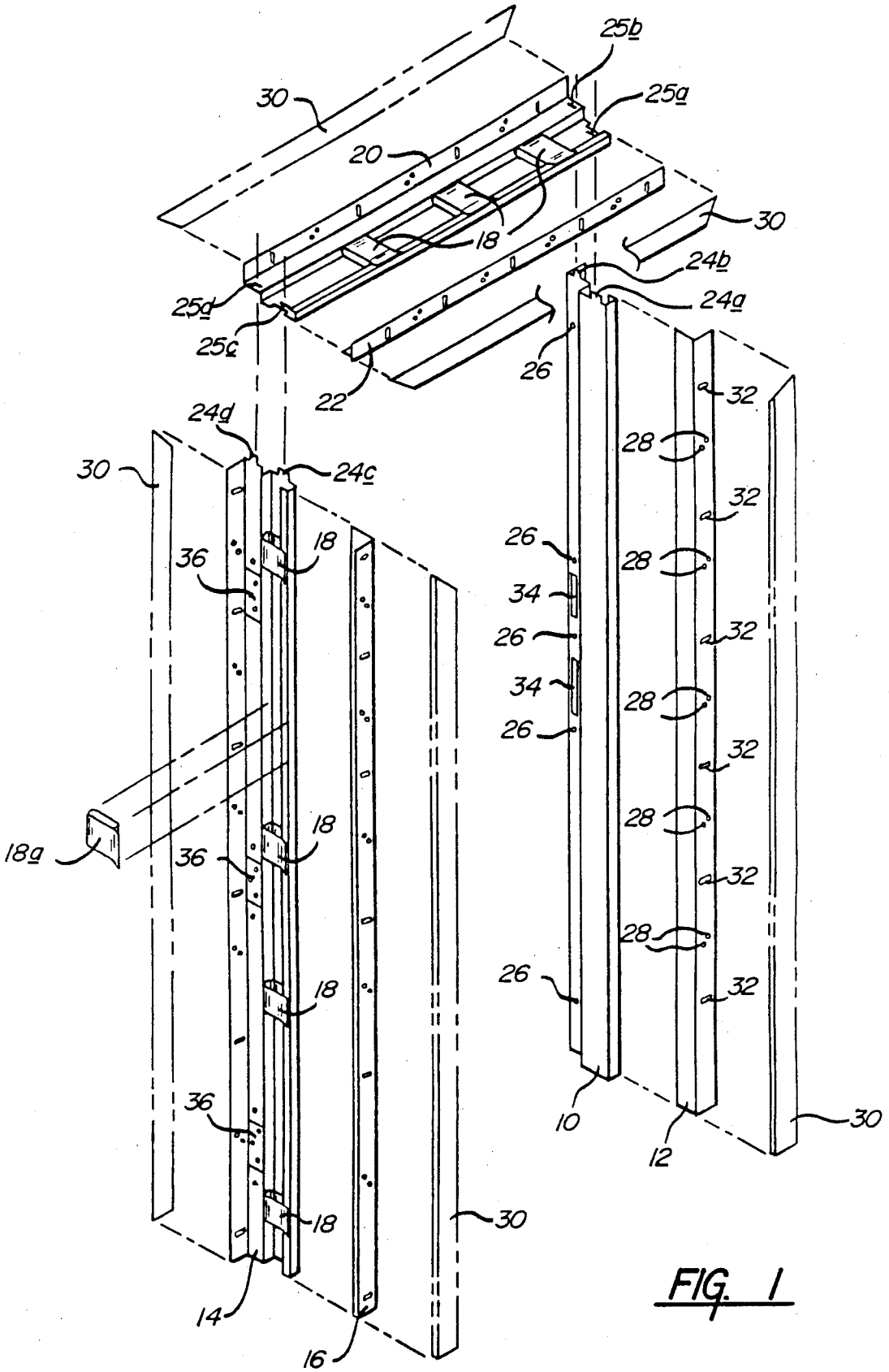
FIG. 1 is an exploded, perspective view of one particular embodiment of an adjustable door frame configured in accord with the principles of the instant invention and illustrating the interaction of the various components thereof.

Referring now to FIG. 1 there is shown in exploded perspective view, a frame assembly structured in accord with the principles of the present invention. The assembly of FIG. 1 is utilized to frame in a door opening in a wall and to provide for attachment of a door and associated hardware thereto. As illustrated, the assembly comprises two jamb sections generally forming the upright or long portions of the frame and a header jamb or head bar piece joining the two upright jambs at right angles and forming the top of the opening. In accord with the principles of the instant invention each of the upright jambs and the head bar are comprised of a frame member and a trim member held together by a spring clip.

As illustrated in the figure the frame assembly includes a strike jamb comprised of a strike jamb member 10 and a trim piece 12 configured to engage therewith. On the opposite side of the door frame, termed the hinge jamb is correspondingly seen a hinge jamb member 14 and its corresponding trim piece 16. Also visible in this view are a plurality of spring clips 18 engaged in a channel formed by the hat portion of the hinge jamb 14. As illustrated one of the clips **18*a* is shown in exploded view, being understood that the clips 18 are normally retained in the channel during use of the assembly. As will be explained in greater detail hereinbelow, the clips 18 and hinge jamb member 14 cooperate to retain the trim piece 16 therein. It will be further noted that the frame assembly includes a header frame member 20, also referred to as a header jamb member; as well as, its corresponding trim piece 22 and clips 18**.

It will be further noted from FIG. 1 that the strike jamb member 10 and hinge jamb member 14 are each provided with a pair of tabs **24*a*–24*d* and the header frame member 20 is provided with a corresponding set of slots 25*a*–25*d* on either end thereof. The slots 25 and tabs 24 engage to rigidify the frame assembly, and the tabs 24** may be bent over to permanently affix the members, thus preventing twisting or flexing of the finished frame. It should be kept in mind that in accord with the principles disclosed herein, different arrangements of tabs as well as other fasteners may be similarly employed. For example, a larger number or smaller number of tabs may be employed; likewise, screw fastenings for other such methods well known to those skilled in the art may be utilized.

In use, the jamb members 10, 14 and 20 of the frame assembly are first placed in the door opening, and the trim pieces 12, 16 and 22 are slid therein where they are retained by the clips 18. Once all parts have been properly aligned, the jamb members 10, 14 and 20 are affixed to the door frame by means of screws, nails or other such fasteners utilizing the preformed holes 26 therein. typically, the jamb members 10, 14 and 20 are first affixed by nailing through nail holes in the face thereof. The nails give sufficient rigidity to the frame, while allowing it to be squared to the opening. Once the jamb members are properly oriented, screws can be driven through coined screw holes 26, (which will be described in greater detail hereinbelow) to allow for shimless installation.

The trim pieces 12, 16 and 22 are similarly affixed to the opening by utilizing preformed holes 28 therein. In order to complete the assembly, moldings 30 may be applied over the exterior portions of the trim pieces 12, 16 and 22 to provide a finished appearance. The moldings 30 may be affixed by nailing or screwing through preformed openings 32 in the trim pieces 12, 16 and 22. The moldings 30 may be wood moldings, steel moldings, synthetic polymeric moldings, or any other such conventionally utilized trim piece.

In this manner, the completed assembly provides a framed in opening adapted to receive a door therein. The strike portion of the jamb 10 includes openings 34 adapted to receive a lock therein. Similarly the hinge jamb 14 is provided with fittings 36 adapted to receive and retain door hinges therein.

Figure 4:
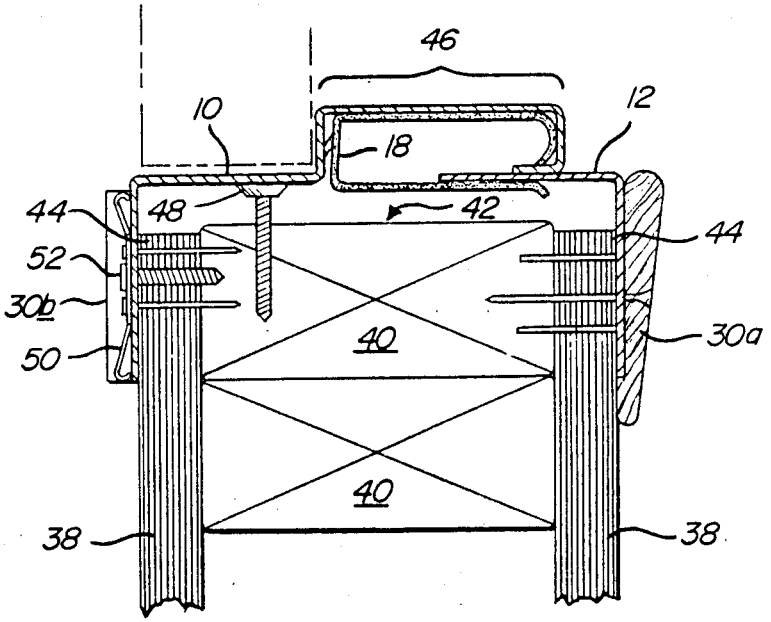
FIG. 4 is an illustration in cross section of the frame assembly of the present invention as disposed to mount a door in a wood stud framed opening.

Referring now to FIG. 4 there is shown in cross section the door frame assembly of the present invention as utilized to affix a door frame to a wood stud framed opening in a wall. Illustrated in the figure is a wall fabricated from two sheets of wall material 38 such as dry wall panel and the like, supported and separated by a pair of wood studs 40. The wall boards 38 and studs 40 cooperate to provide an opening in the wall, said opening adapted to receive the door. As mentioned previously, this opening may be of irregular dimensions, depending on the thickness and regularity of the wallboard and studding utilized, as well as the skill of the carpenter.

It should be noted that as utilized herein the term "opening" is meant to define such a framed aperture. It should further be noted that the opening is defined as having an interior periphery 42 formed by the edges of the wall board 38 and the base of the studs 40. Analogously, the opening includes an exterior peripheries 44 formed upon the exterior faces of the wall proximate the interior periphery 42. The frame assembly includes a first frame member (shown here as a strike jamb member 10 generally similar to that of FIG. 1) adapted to receive and stop the travel of a door (shown here in phantom outline). It will be noted that the frame member has a generally planar interior surface adapted to be supported by at least a portion of the interior periphery 42 of the opening. The frame member further includes a hat portion 46 configured so as to define a raised channel extending along the longitudinal axis of the frame member. The channel is substantially closed proximate the exterior surface of the member and substantially open proximate the interior surface. Retained within the channel is a clip member 18 configured so as to be retained therewithin and further configured so as to grip a trim piece 12 retained therein. It will be appreciated from this figure that the trim piece 12 may be slid in or out of the clip 18 so as to accommodate wall thicknesses of varying dimensions.

Also obvious from the drawing is the manner in which the frame member 10 and trim piece 12 are affixed to the wall. As shown, the frame member 10 includes a coined or threaded opening 48 adapted to receive a screw therein. Coining is a metal forming process in which an opening provided by flattening and shaping operations is adapted to engagingly grip the threads of a screw. By the use of a coined opening, the frame member 10 is provided with the capability of allowing for shimless installation. The threads formed by the coining process support a screw member and allow it to engage a spaced apart surface, such as the interior periphery 42 of the opening. In addition to coining, other thread forming processes well known to those of skill in the art may be similarly employed so as to secure the advantages of shimless installation. In those instances where shimless installation is not desired or required, the coined openings can be eliminated. In a typical installation, the base of the jamb member 10 is first affixed to the exterior periphery of the opening, as for example by nailing. This allows the jab to be squared with relation to the opening. Once a square relationship is established, screws are driven through the coined opening 48, which maintains the jab 10 in spaced apart relationship with the studs 42. By the use of large, long screws or rails for affixing the frame, a high degree of strength and security may be had; additionally, such an arrangement transfers the load of the door and frame to the wall.

The frame member 10 is generally affixed to the exterior periphery 44 of the door opening by means of nails, screws or other such fasteners inserted through the preformed openings therein as previously described. The trim piece 12 is retained by the spring clip 18 proximate the interior periphery 42 of the door opening. Consequently no nails or screws are needed to maintain such affixation. The trim member 12 is typically affixed to the exterior periphery of the opening by means of nails or screws as previously discussed.

In order to complete the assembly, a molding 30 is generally installed. FIG. 4 depicts the use of both clip-on metal moldings and the more common nail on wood moldings. As shown the exterior periphery of the opening most proximate the trim piece 12 is provided with a wooden molding 30*a* nailed through openings in the trim piece 12. A metal molding 30*b* is used to finish the frame member side of the opening. As is well known to those of skill in the art such molding is affixed through the use of a plurality of clips 50 which engage the case of the molding 30*b*. The clips 50 are affixed by means of a screw 52 or other similar fastener which is preferably driven into the wall board 38 through preformed openings in the frame member 10.

Figure 5:
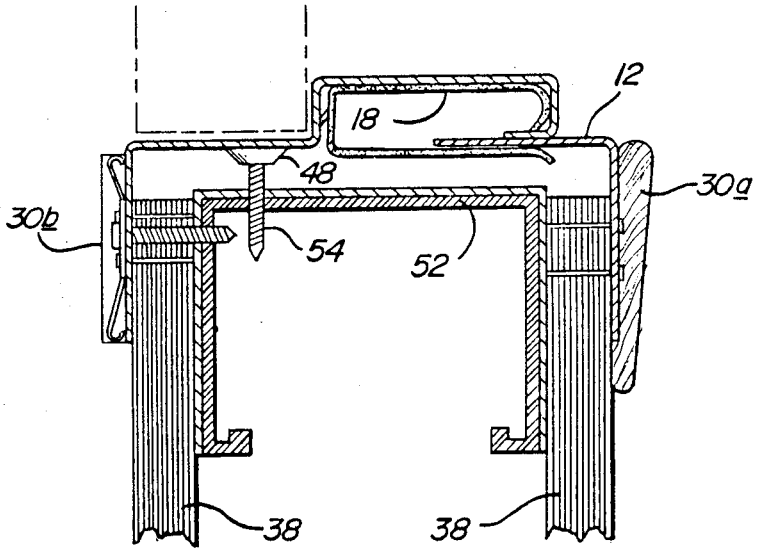
FIG. 5 is an illustration in cross section of the frame assembly of the present invention as employed to mount a door in an opening by a steel stud assembly.

FIG. 5 illustrates a similar installation to that of FIG. 4, but as adapted to affix a frame assembly to a metal stud supported wall system. As illustrated in FIG. 5, the wall opening is defined by a metal stud 52 having wall panels 38 affixed thereto. The frame member 10 is affixed to the metal stud 52 by means of a screw 54 extending through a coined opening 48 in the frame member 10. The installation is completed by the use of a trim piece 12 and moldings 30*a*, 30*b* as previously described. It will generally be appreciated by those of skill in the art that FIGS. 4 and 5 are for purposes of illustration only and that variants in the illustrated embodiments are likely to be encountered in use of the invention. For example, while the installation is depicted as utilizing both wood and metal moldings it is generally to be expected that both sides of a installation will use wood or metal moldings. Similarly, different placement of nails and/or screws may be accomplished in accord with the principles disclosed herein.

Referring now to FIG. 2A there is shown a perspective view of one particular clip 18 of the present invention. As illustrated the clip 18 includes a clip hook portion 56 and a tongue portion 58 adapted to grip and engage a trim piece inserted therebetween. Toward this end it will be generally appreciated that the clip 18 is fabricated from a resilient material such as spring steel and adapted to maintain the tongue 58 and clip hook 56 in a biased together relationship.

Fabrication of such clips 18 generally includes a heat treating step wherein springiness or temper is imparted to the member. Such heat treating often changes the dimensions of the clip. Such changes are of predictable magnitude and may be compensated for by establishment of appropriate dimensional tolerances; also, it has been found most advantageous to include at least one, and in this illustrated embodiment two, tension teeth 60 proximate the tongue portion 58 of the clip 18. Such tension teeth 60 increase the gripping action of the clip 18 upon a trim piece inserted therein. FIGS. 2B and 2C are alternate views of the clip 18 better illustrating the tension teeth 60 as well as placement of a pair of barbs or retainer prongs 62 upon the clip. The retainer prongs 62, as will be described in greater detail hereinbelow assist in retaining the clip within the channel formed by the hat portion of the assembly. As will be readily apparent from FIG. 2C, the retainer prongs 62 are formed upon the rearmost portion of the clip, i.e., the portion distal the clip hook 56.

Referring now to FIG. 3A and 3B there is shown the installation of the clip 18 into the channel of a frame member 10. As illustrated in FIG. 3*a*, the frame member 10 may include a jamb hook 64 formed by turning a portion of the material thereof under so as to partially enclose a portion of the channel formed by the hat portion 46. By so doing, additional strength is given to the jamb, so as to prevent warping or bending. This feature allows for the use of lighter gauge metal in its fabrication.

In order to engage the clip 18, the jamb hook portion 64 of the frame member 10 is inserted between the tongue 68 and clip hook 56 of the clip 18. The clip is pushed forward and down so as to engage the jamb hook 64 between the clip hook 56 and tongue 58 of the clip 18. The prongs 62 engage the other wall of the channel. As will be appreciated in FIG. 3B, the jamb hook 64, tongue 58 and clip hook 56 cooperate to provide a pair of gripping surfaces adapted to engage a trim member inserted therein. It will also be appreciated that various other configurations of channel may be similarly employed, the instant invention not being precisely limited to that depicted herein. For example, the jamb hook 64 may be dispensed with and the clip 18 retained within the channel by the two spaced apart walls thereof. In such a mode, the tongue 58 and clip hook 56 will cooperate to retain a trim piece. It will further be appreciated from FIG. 3B that the clip 18 may be removed or repositioned from its location within the channel by inserting a screwdriver or other such prying tool into the space between the hook 18 and the channel wall, preferably proximate the retainer prongs 62, and prying upwards.

Referring now to FIG. 6 there is shown yet another embodiment of a frame assembly of the present invention as modified to include kerf adapted to hold a weatherstripping material therein. The frame assembly of FIG. 6 is generally similar to that illustrated with references to the foregoing figures and accordingly like features will be referred to by like reference numerals. The assembly generally comprises a frame member 10' having a clip 18 retained therein and a trim piece 12. Where the frame of FIG. 6 differs from those previously described is in the configuration of the hat portion 46' of the frame member 10. The hat 46' includes a bent over portion configured so as to define a kerf or groove 70 extending the length thereof. This kerf 70 is adapted to retain a weatherstripping member therein.

It is frequently desirable to include a weatherstrip material, particularly in residential doors, especially those interfacing with the exterior environment. Such weatherstripping material is well know to those of skill in the art and, as illustrated in FIG. 6 the door frame assembly includes a magnetic weatherstrip member 72 therein. The weatherstrip member comprises an L-shaped portion 74 adapted to slide into and be retained by the kerf 70 and further includes a magnetic sealing portion 76 and a flexible attachment member 78 for affixing the magnetic portion 76 to the mounting member 74.

Obviously, magnetic weatherstripping is usable only with steel doors. In the instances where nonferrous doors are employed weatherstripping of the compressive sealing type is generally preferred. Referring now to FIG. 7, there is shown in cross section a portion of such compressive weatherstripping 80. It will be readily apparent from the drawing the manner in which such weatherstripping 80 may be utilized in conjunction with the assembly of FIG. 6. As depicted, the weatherstripping 80 includes a sealing portion 82 and a tab portion 84. The tab portion 84 is analogous to the mounting member 74 of the weatherstrip of FIG. 6 and the sealing portion 82 is analogous to the magnetic portion of the foregoing weatherstrip. In use, the tab portion 84 is inserted in the kerf 70 and closure of the door compresses the sealing portion 82 thereagainst.

Use of a kerf eliminates the problems previously encountered in the mounting of weatherstripping by means such as screws or nails or adhesive. Screwing or nailing weatherstripping to a door frame assembly destroys a portion of the weatherstripping itself preventing optimal seal. Use of adhesive material engenders other problems when replacement or removal of the weatherstripping is necessary. By the use of a kerf assembly, weatherstripping may be readily replaced with a minimum of effort. Obviously, other types of weatherstripping such as felt or cloth weatherstripping may be similarly employed. In the event that kerf weatherstrip installation is not desired, the door frame assemblies of the present invention may be utilized in conjunction with the heretofore discussed adhesive mounted weatherstrip.

There are numerous modifications which may be made to the embodiments illustrated herein. Referring now to FIG. 8, there is shown another version of clip 90 structured in accordance with the principles of the present invention. The clip 90 is generally similar to those clips previously described however it includes at least one bonding prong 92 upon the top surface thereof. A clip of this design is particularly advantageous because the bonding prong 92 serves to bias the clip 90 into better contact with the hat portion 46 of the frame assembly and further serves to maintain tension upon the retaining prongs 62 of the clip 90. A clip such as that illustrated in FIG. 8 is particularly useful in conjunction with a frame as illustrated in FIG. 6 because the addition of the bonding prong 92 serves to maintain very tight contact between the retainer prong 62 and the inward bent portion of the kerf 70 in the hat 46'.

Advantages of the present invention reside in the fact that it is easy and economical to manufacture and use. The fact that welding steps are eliminated in fabrication of the door frame assembly allows for the use of relatively inexpensive prepainted metallic materials. For example, prepainted steel is available in a variety of colors and sizes and such material may be readily formed into trim pieces and frame members for use in the present invention. Similarly anodized or galvanized stock may be employed as may be wood, pressed board or synthetic polymeric materials.

It is particularly noteworthy that the clips are the only items in the assembly which require any degree of precision in their fabrication. The clips may be manufactured at low cost and with very high degrees of precision through the use of manufacturing equipment such as a four-slide machine and the like. The remainder of the assembly can be fabricated to lesser tolerances by roll forming, press brake forming or other such high volume techniques.

Use of the present door frame assembly results in a savings in terms of time required by skilled labor to properly fit a door frame. In the event that the opening of the frame is wider at one end thereof than the other, simple adjustment of the extension of the trim piece will accommodate such irregularity. Likewise, in the event that a door opening is of a non-standard size adjustment is readily accomplished. Shipping and handling of the frames of the present invention is greatly simplified since there are no large, high precision components. The clips are small and rugged, and the frame members and trim pieces can accommodate large dimensional variations without loss of function.

As mentioned previously, the assemblies of the present invention may be utilized in combination with prehung doors, in which instance a frame member including at least two upright jambs and a header will be inserted into an opening and trim pieces fitted therein to accommodate the thickness of that opening. The frame may be provided with hinges or other attachments for a door, or may already include a door hung therein. Although not specifically discussed, the frame assembly of the present invention may obviously be used in conjunction with a double swing door assembly, wherein two doors are mounted in a single frame. In such an installation, two hinge jambs will be provided in accord with the principles disclosed herein. The present invention has significant utility in the construction industry because of its savings of time, storage space and skilled labor. Accordingly it will be appreciated that although the present invention has been illustrated with reference to door frames, it may equally well be adapted to use in any instance where it is desired to frame in an opening in a wall. As such, the present invention will have utility in installation of windows, door walls, screens, skylights and other such items.

In light of the foregoing it should be clear that numerous modifications and variations of the present invention will be apparent to one of skill in the art. Accordingly, the foregoing drawings, discussion and description are merely meant to be illustrative of certain principles of the present invention and not limitations there-upon. It is the following claims, including all equivalents which define the scope of the invention.

We claim:

1. A frame assembly adapted to be fitted into an opening in a wall, said assembly including:

a frame member elongated along a longitudinal axis thereof and having a generally planar interior surface adapted to be supported by, and cover a portion of the interior periphery of the opening, and an exterior surface disposed distal said interior periphery, the frame member further including a hat portion defining a raised channel extending along the longitudinal axis of the member, said channel being substantially open proximate the interior surface and including a jamb hook portion comprising a flange which is generally coplanar with the interior surface of the frame member;

at least one resilient clip member configured to include a clip hook portion operative to engage the jamb hook so as to support the clip member in the raised channel without affixation to said wall, said clip member further including a tongue portion; and a generally planar trim piece of substantially the same length as the frame member, said trim piece having a first portion adapted to be slidably retained by contact with the tongue portion of said clip and a second portion adapted to cover at least a portion of the interior periphery of said opening not covered by the frame member, whereby sliding of the trim piece in the clip permits the frame assembly to be expanded to accommodate the differing interior peripheries associated with various thicknesses of walls.

2. A frame assembly as in claim 1, wherein the frame member is further adapted to cover at least a portion of the exterior periphery of the opening.

3. A frame assembly as in claim 1, wherein said frame member includes a plurality of holes therein adapted to receive attachment members whereby said frame member may be affixed to the interior periphery of the opening.

4. A frame assembly as in claim 1, wherein said frame member is fabricated from a material selected from the group consisting essentially of: steel, galvanized steel, aluminum, anodized aluminum, synthetic polymeric materials, wood, compressed particle board, and combinations thereof.

5. A frame assembly as in claim 1, wherein said frame member is fabricated from steel which has been painted prior to fabrication.

6. A frame assembly as in claim 1, wherein said frame member includes two jamb sections adapted to be disposed perpendicularly in said opening and a header section adapted to be disposed horizontally in said opening at substantially right angles to said jamb sections.

7. A frame assembly as in claim 6, wherein said frame member further includes at least one tab and slot disposed so as to fasten at least one of said jamb sections to said header.

8. A frame assembly as in claim 7, wherein each of said jamb sections includes a pair of tabs associated therewith and wherein said header includes at least two sets of slots at opposite ends thereof adapted to engage said tabs, whereby said jamb sections and header may be assembled into a rigid unit.

9. A frame assembly as in claim 1, wherein said hat portion includes a kerf adapted to retain a weatherstrip therein.

10. A frame assembly as in claim 1, wherein said clip member includes a gripping portion adapted to engage an interior portion of the channel and retain the clip therein.

11. A frame assembly as in claim 10, wherein said clip is a metallic member and the gripping portion thereof comprises at least one retaining prong formed in said metallic clip.

12. A frame assembly as in claim 1, wherein said clip is a spring steel member.

13. A frame assembly as in claim 12, wherein said tongue has associated therewith at least one tension tooth operative to increase the gripping action of the clip upon a trim piece inserted therein.

14. A frame assembly as in claim 1, wherein said clip has at least one bonding prong associated therewith, said prong configured and disposed to assist in retaining the clip in the raised channel formally the hat portion of the frame assembly.

15. A frame assembly as in claim 1, wherein said clip hook portion is adapted to engage the flange of the jamb hook between itself and the tongue portion so as to facilitate retention of the clip and to increase holding tension on a trim piece interposed between said tongue portion and said flange.

16. A frame assembly as in claim 1, wherein said trim piece is an elongated member having a generally L-shaped cross section, one leg of which is adapted to be disposed upon and cover said portion of the interior periphery and the other leg thereof is adapted to engage and cover a portion of the exterior periphery of the opening.

17. A frame assembly as in claim 1, wherein said trim piece is fabricated from a material selected from the group consisting essentially of: steel, galvanized steel, prepainted steel, aluminum, anodized aluminum, synthetic polymeric materials and combinations thereof.

18. A pre-hung door assembly configured to be fitted into an opening in a wall and comprising:

a frame member adapted to receivably retain a door therein, said frame member including a header member, two jamb members disposed at right angles to opposite ends of one face of said header member, a raised hat portion extending longitudinally along said jamb members and header member and defining an open channel, said channel including a jamb hook portion comprising a flange;

a plurality of resilient clips each configured to include a clip hook portion operative to engage the jamb hook so as to support the clip in the raised channel without affixation to the wall, each clip further including a tongue portion; and three generally planar trim pieces, a first and second trim piece corresponding in length to the jamb members and a third trim piece corresponding in length to the header member, each trim piece adapted to be slidably retained by contact with the tongue portions of said clips, whereby the pre-hung door assembly may be adjusted in size so as to accommodate various thicknesses of door openings.

* * * * *